US005351839A

United States Patent [19]

Beeler et al.

[11] Patent Number: 5,351,839

[45] Date of Patent: Oct. 4, 1994

[54] VERTICALLY ADJUSTABLE PUSHER POINT OF PURCHASE DISPLAY

[75] Inventors: Mark T. Beeler; Brian H. Welker, both of Winston-Salem, N.C.

[73] Assignee: Decision Point Marketing, Inc., Winston-Salem, N.C.

[21] Appl. No.: 30,812

[22] Filed: Mar. 12, 1993

Related U.S. Application Data

[63] Continuation-in-part of Ser. No. 952,245, Sep. 28, 1992.

[51] Int. Cl.[5] ..... A47F 5/00

[52] U.S. Cl. ..... 211/59.3; 211/59.1; 211/193

[58] Field of Search ..... 211/59.3, 59.2, 193, 211/187, 90, 57.1, 59.1; 312/42, 71

[56] References Cited

U.S. PATENT DOCUMENTS

| | | | |
|---|---|---|---|
| 2,730,825 | 1/1956 | Wilds | 40/10 |
| 2,954,129 | 9/1960 | Gordon | 211/59.3 |
| 3,110,402 | 11/1963 | Mogulscu | 211/59.3 |
| 3,308,961 | 3/1967 | Chesley | 211/59.3 |
| 3,357,597 | 12/1967 | Groff | 221/279 |
| 3,848,745 | 11/1974 | Smith . | |
| 4,351,439 | 9/1982 | Taylor . | |
| 4,479,583 | 10/1984 | Franklin et al. | 211/59.2 |
| 4,705,175 | 11/1987 | Howard et al. | 211/59.2 |
| 4,729,481 | 3/1988 | Hawkinson et al. | 211/59.3 |
| 4,730,741 | 3/1988 | Jackle et al. | 211/59.3 |
| 4,733,782 | 3/1988 | Spezial et al. | 211/57.1 |
| 4,762,235 | 8/1988 | Howard et al. | 211/193 X |
| 4,762,236 | 8/1988 | Jackle et al. | 211/59.3 |
| 4,830,201 | 5/1989 | Breslow | 211/184 |
| 4,898,282 | 2/1990 | Hawkinson et al. | 211/49.1 |
| 4,907,707 | 3/1990 | Crum | 211/59.3 |
| 4,923,070 | 5/1990 | Jackle et al. | 211/59.2 |
| 5,012,936 | 5/1991 | Crum | 211/59.3 |
| 5,027,957 | 7/1991 | Skalski | 211/59.3 |
| 5,088,607 | 2/1992 | Risafi et al. | 211/59.3 |

*Primary Examiner*—Robert W. Gibson, Jr.
*Attorney, Agent, or Firm*—Rhodes Coats & Bennett

[57] ABSTRACT

An apparatus for displaying goods in a retail environment includes a frame having sideboards, a rear board and a plurality of upright standards, each standard having a plurality of apertures spaced therealong, and a plurality of supports having knife brackets and crosswise-extending bars. Each support is affixed to two of the standards by insertion of its knife brackets into apertures of the standards and each includes forwardly-extending rails. A plurality of trays each include a plurality of location means across a width of the tray and is supported on the rails of one of the supports. The trays have first and second protrusions from their undersides, the first protrusion adapted to engage the crosswise-extending bar to support the tray in a first, retracted package-displaying position, and the second protrusion adapted to engage the bar to support the tray in a second, extended, package-loading position. A plurality of product pushers is releasably connected to the trays and positioned in the trays in reference to the location means. Goods to be displayed may be positioned forwardly of the product pushers to urge them to one end of the tray for retail purchase and the apparatus may be disassembled to arrange a different plurality of product pushers differently in the tray and a different plurality of supports, trays and forwardly-extending rod assemblies, differently along the standards.

20 Claims, 9 Drawing Sheets

VERTICALLY ADJUSTABLE PUSHER POINT OF PURCHASE DISPLAY

RELATED APPLICATIONS

The present application is a continuation in part of U.S. application Ser. No. 07/952,245 filed Sep. 28, 1992 entitled "Variable Pusher Point of Purchase Display," the entire disclosure of which is hereby incorporated by reference.

BACKGROUND OF THE INVENTION

The present invention relates to improvements in point-of-sale displays, particularly those that have aids to urge product toward the front of the shelf, known in the trade as "pusher"-type displays.

It is known to display packages such as envelopes of pantyhose in a self-feeding arrangement. This includes a rack having side walls and horizontally extending bars with a tray supported on the bar in a slanted manner. The tray is divided into channels and a box of, literally, rocks is positioned behind the product in the channels. By virtue of the slant of the channel, the box of rocks pushes the products forwardly in the channel as each forwardmost package is removed. This arrangement has been used successfully for a number of years, but it has a number of disadvantages. First, the rocks, being provided simply for the purpose of providing weight, make the entire display a very heavy device, raising shipping costs. Also, since the tray in which the product is displayed is integrally formed, the channels are of an invariable size. Thus, to display products of a different size, the entire tray and boxes of rocks must be discarded and be replaced by a different product. Furthermore, it has been found that the box of rocks may lose or absorb moisture and these can be a source of biological activity giving rise to unsightly growths, clearly undesirable in a merchandising environment.

Spring-driven pusher displays are known, such as those shown in U.S. Pat. No. 4,830,201 to Breslow and assigned to RTC Industries, Inc. That display uses a spring-urged motive member to direct product toward the front of a shelf, with the spring being mounted on a component which acts as a divider as well as a spring anchor. The apparatus of the Breslow patent can be used with merchandise of various sizes, but the side dividers must be positioned with care, something that does not invariably happen in field installations. The result may be the dividers are positioned too close together, so that the product is pinched and does not advance properly. Or, the dividers may be too far apart, so that the product is delivered sideways or, simply that valuable shelf space will be wasted.

Accordingly, there is a need in the art for a point of purchase display having pusher capability, but which can be easily and inexpensively modified to vary from one product size to another, without requiring expensive field expertise.

SUMMARY OF THE INVENTION

The present invention fulfills this need in the art by providing an apparatus for displaying goods in a retail environment that includes a frame having an upright standard with a plurality of affixation elements spaced along the standard. A plurality of supports are releasably affixed to the standard by affixation to the affixation elements and include forwardly-extending rails. A plurality of trays are provided, each including a plurality of location means across a width of the tray and supported on the rails of one of the supports. A plurality of product pushers are releasably connected to the trays and positioned in the trays in reference to the location means. Thus, goods to be displayed may be positioned forwardly of the product pushers to urge tile goods to one end of the tray for retail purchase, and the apparatus may be disassembled to arrange a different plurality of product pushers differently in the tray and a different plurality of supports and trays differently along the standard.

Preferably, the supports have crosswise-extending bars and the trays have first and second protrusions from their undersides. The first protrusion is adapted to engage the bar to support the tray in a first, retracted package-displaying position, and the second protrusion is adapted to engage the bar to support the tray in a second, extended, package-loading position.

Preferably, the frame has a plurality of the standards and each support is affixed to two standards. Desirably, the standards are spaced apart 16 inches. The frame may have sideboards and a rear board.

In a preferred embodiment the affixation means takes the form of apertures in the standard, and the supports are affixed to the standards by knife brackets which enter the apertures.

The invention permits great versatility in the arrangement of the display. For example, a rear board such as a pegboard may be affixed to the standard at a location on the frame not occupied by a support and tray. A forwardly-extending rod assembly may be affixed to the standards at a location on the frame not occupied by a support and tray. The assembly is desirably affixed to two standards, by knife brackets which enter the apertures of the standards. The forwardly-extending rod assembly may include a cross-wise extending channel, with the rods selectively located along the channel. It may include spacers and a product identification panel, the spacers projecting the panel forwardly from the standard and the panel adapted to receive product-identifying indicia.

The invention also provides a method of displaying goods in a retail environment including providing a frame having an upright standard with a plurality of affixation elements spaced along the standard, releasably affixing a plurality of supports having forwardly-extending rails to the affixation elements, releasably connecting a plurality of product pushers to a plurality of trays in reference to location means across the widths of the trays, placing the trays on the rails of the supports, and displaying goods forwardly of the product pushers to urge the goods to the forward end of the tray for retail purchase.

The method may proceed by disassembling the trays, pushers and supports and arranging a different plurality of product pushers differently in the trays and a different plurality of supports and trays differently along the standard.

Preferably the affixing step comprises affixing each support to two standards. The affixing step may include inserting knife brackets on the supports into apertures in the standard.

The method may also include affixing a rear board to the standard at a location on the frame not occupied by a support and tray. It may also include affixing a forwardly-extending rod assembly to the standard at a location on the frame not occupied by a support and tray and hanging goods from forwardly-extending rods of the assembly. If the forwardly-extending rod assembly includes a cross-wise extending channel, the method may include locating the rods selectively along the channel. If the forwardly-extending rod assembly includes spacers and a product identification panel, the method may include applying product-identifying indicia to the panel.

BRIEF DESCRIPTION OF THE DRAWINGS

The invention will be better understood after a reading of the Detailed Description of the Preferred Embodiments and a review of the drawings in which.

DETAILED DESCRIPTION OF THE PREFERRED EMBODIMENTS

Figure 1:
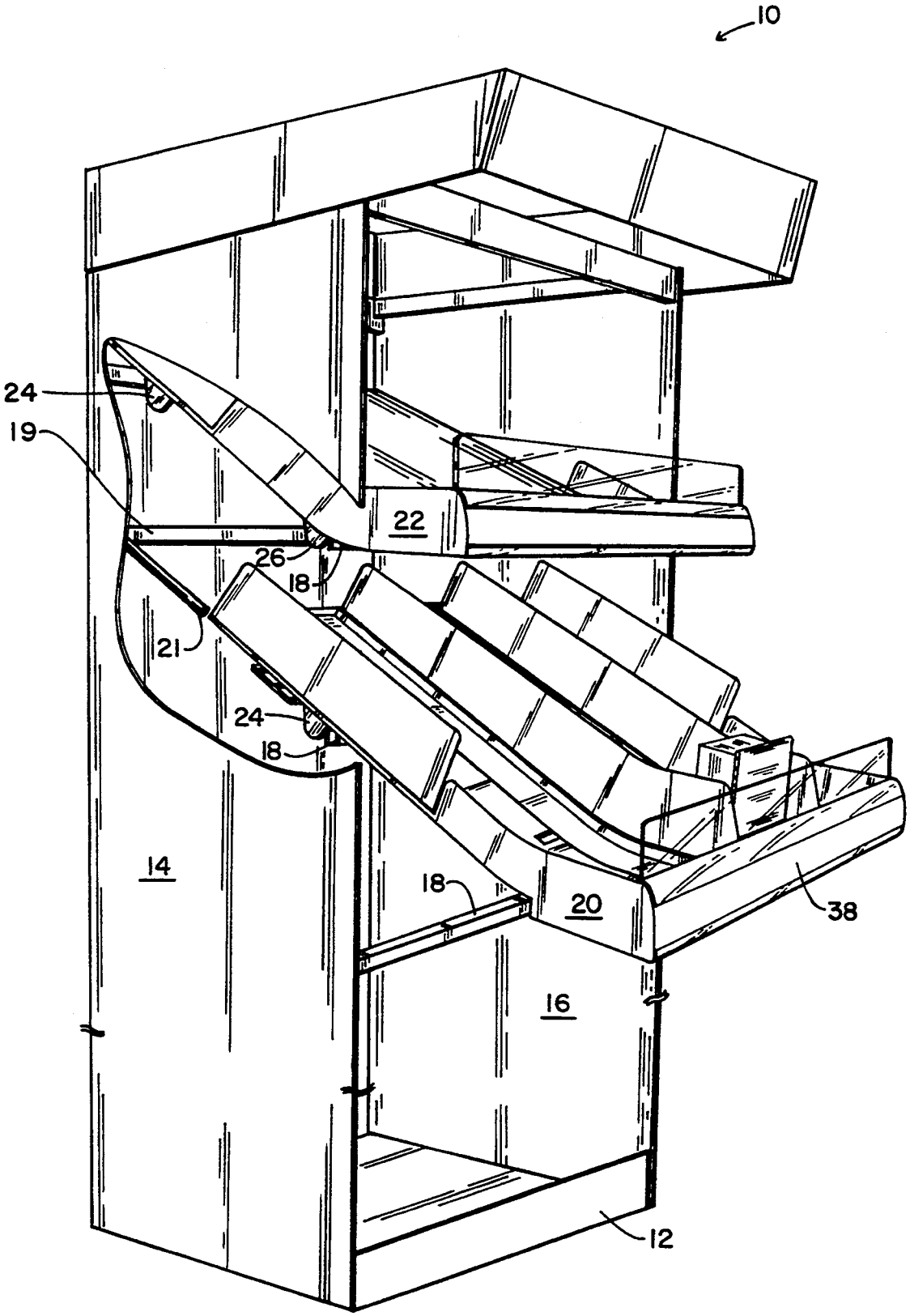
FIG. 1 is a perspective view of a retail rack including apparatus according to an embodiment of the first aspect of the invention.

Referring now to FIG. 1, a display rack 10 for a product is depicted. As shown in FIG. 1, the product is set up as a point-of-purchase pusher display for packages of pantyhose. Of course, the product to be dispensed and sold is not material, and the various components of the invention can be suitably sized end shaped to accommodate the product being dispensed.

The rack 10 includes a base 12 and side walls 14, 16. A plurality of front bars 18 interconnect the side walls to provide rigidity to the rack 10 and for further purposes to be described. Similarly, rear bars 19 provide additional rigidity. Stantedly arranged between a front bar and a rear, higher bar are side rails 21. The side rails 21 provide support for the display assemblies, such as display assemblies 20,22. The display assembly includes trays 30 which have lower protrusions 24,26. These protrusions are located on the trays so as to provide a backstop for the tray against the front bars 18. Thus, as can be seen in FIG. 1, the protrusion 26 of the assembly 22 engages the bar 18 to hold the upper assembly 22' retracted in the rack 10. The lower assembly 20 is held in an extended position by the abutment of the protrusion 24 against its bar 18.

Thus, each of the assemblies 20,22 can have either of the positions shown in the drawing. In the extended position such as depicted with respect to assembly 20, the channel portions of the assembly are exposed so store personnel cam easily restock the merchandise. The retracted position as shown with respect to assembly 22 makes an attractive and compact display of the product for the customers.

Figure 5:
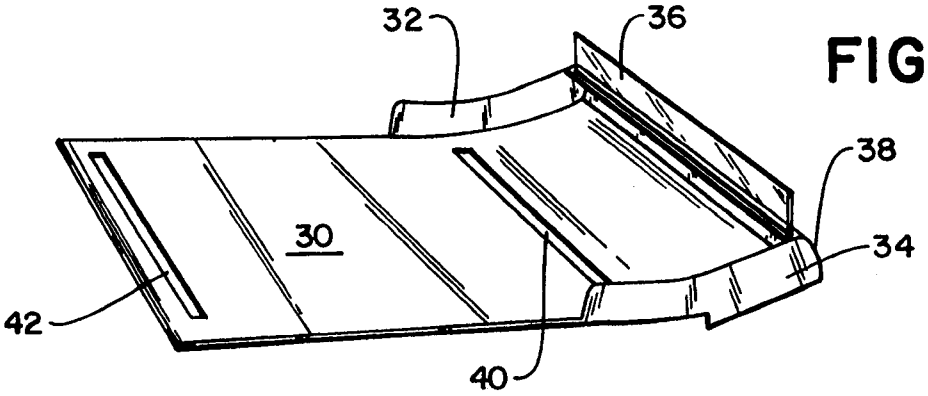
FIG. 5 is a perspective view of the tray component.
Figure 2:
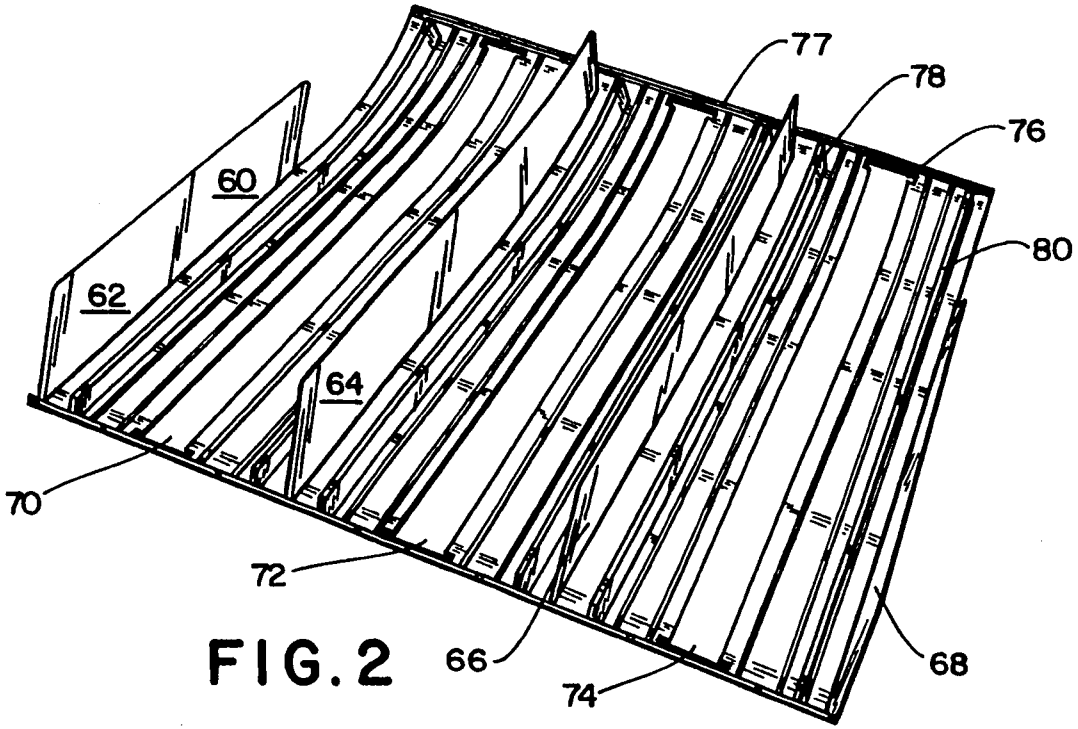
FIG. 2 is a perspective view of the divider insert component of the display of the invention.
Figure 6:
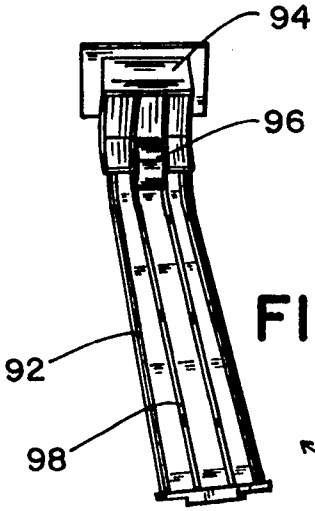
FIG. 6 is a perspective view of the track element of the product pusher component for the second aspect.
Figure 3:
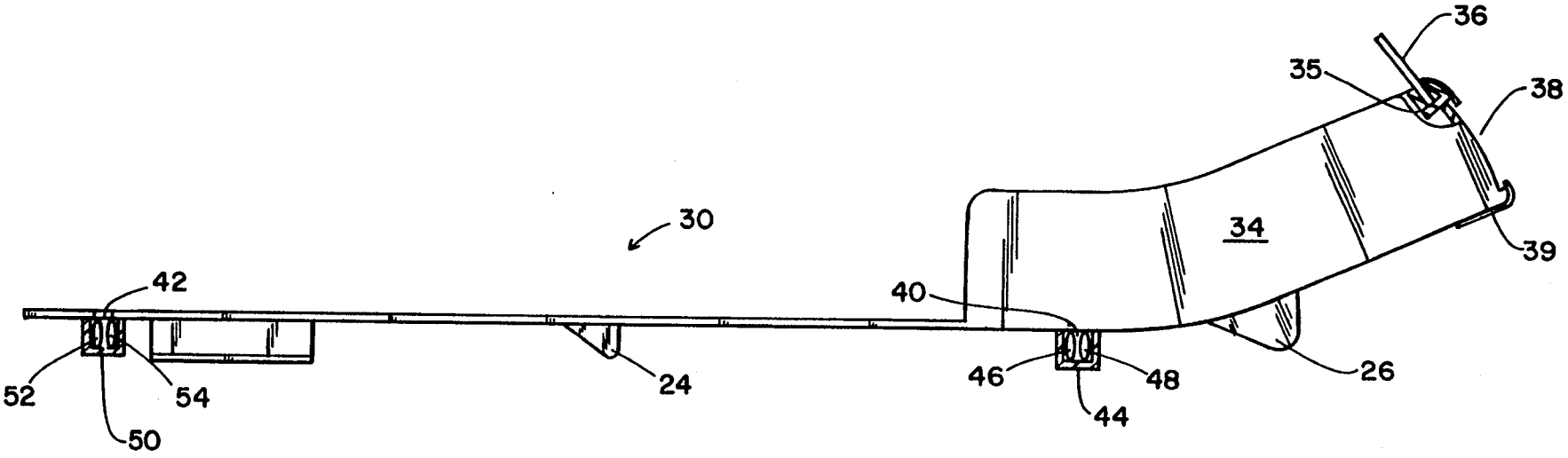
FIG. 3 is a side elevation view of the tray components.

FIGS. 2, 5 and 6 illustrate the three main components of one of the assemblies 20,22 in perspective. The assembly includes a tray 30 having side walls 32,34, a front-facing card channel 38 and a transparent product hold-back portion 36 above the card channel. Laterally extending female connector portions 40,42 are provided in lower and upper portions of the tray 30. More details of the tray can be seen in FIG. 3, a side elevation view of the tray. Thus, the card channel 38 is formed by a cowl 39 glued over a formed depression to make a "raise and drop" card channel extending all across the front of the tray. One card can be printed having several items of product-specific information, each arrayed in a width corresponding to a channel width, to identify merchandise in the channel behind that portion of the card. Also visible in FIG. 3 are the protrusions 26,24 discussed above with respect to FIG. 1.

The lower female connector portion 40 is made up of a formed groove 44 in the tray portion and two juxtaposed resilient members 46,48. Similarly, the upper female connector portion is made up of the formed groove 50 and juxtaposed resilient elements 52,54.

Referring back to FIG. 2, a divider insert is shown, sized to be slightly smaller than and therefore to be able to fit into the tray 30. The divider insert 60 is shown having side wall portions 62,68 which extend rearwardly of the corresponding side walls 32,34 of the tray 30 when the insert is located in the tray. Of course, numerous variations of the relative sizes of the side wall in the tray and divider insert may be contemplated. The divider insert also has interior dividers 64,66. Thus, a channel is formed between, on the one hand, the side walls 32,62 and the wall 64. Similar channels are formed between the other dividers and side walls.

Each channel is provided with a longitudinally extending hole, such as holes 70,72,74. Preferably, the holes extend the entire length of the channels, however, they could merely be located to overlay the female connector portions 40,42 when the divider insert is located in the tray 30. The divider insert preferably has wider portions for the holes forwardly and rearwardly, such as the widened portions 76 for the hole 74 shown in the drawing. Rails 78,80 are provided in each of the channels for the purpose of reducing friction in the movement of product along the channel. The tray 30 is provided with rearwardly extending boss 35 and the divider insert 60 is provided with a forward raised portion 77 to assist in locking the divider insert in position in the tray 30 by fitting under the boss 35.

The divider insert 60 is shown defining three channels of a specific width, but the invention specifically contemplates other numbers of channels, with each channel as wide as the product to be dispensed and sufficient in number to extend the width of the tray 30. In addition, the channels need not all be the same size, and some tray space may remain unused, although that is not preferred.

Figure 4:
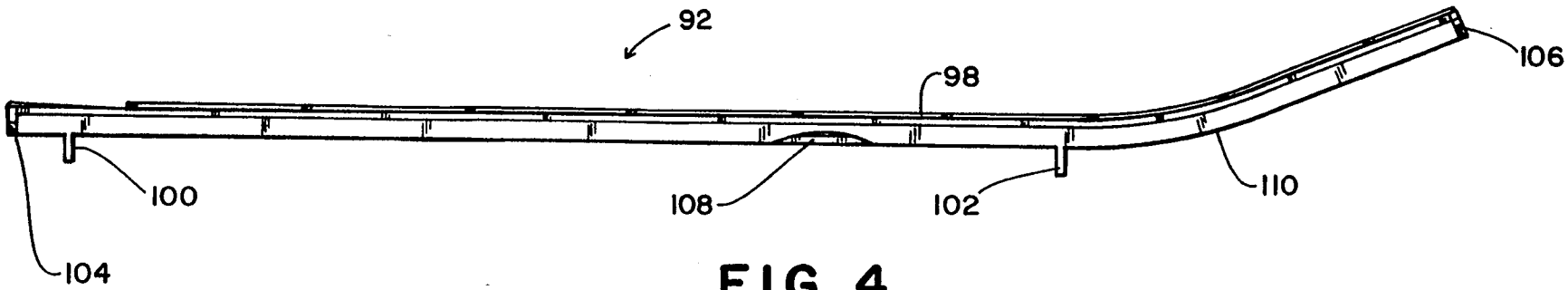
FIG. 4 is a side elevation view of the track element of the product pusher component.

The third component of the assembly is a product pusher 90, as seen in FIG. 6. The product pusher 90 includes a track element 92, a pusher element 94, and a spring 96. FIG. 6 is a rear perspective view of the product pusher. The spring 96 has its outer, free end secured in a front portion of the track element in a conventional fashion, and the coiled portion of the spring engages the rear of the pusher element 94 to push it toward the front. The track element includes rails 98 formed in the top of it, again to reduce friction for the product being moved along the track. The rails also provide a bed in which the spring can be housed to as to prevent the spring from interfering with the product resting on the track element. Further details of the track element 92 can be seen in the side view shown in FIG. 4. Protruding downwardly from the track are male connector portions 100,102, spaced apart a distance substantially identical to the distance between the female connector portions 40,42 of the tray 30. The male portions 100, 102 may be simply flat tabs of substantial thickness which, when depressed into the female connector portions 40,42 are frictionally engaged by the juxtaposed resilient materials in the female connector portions. In addition, the track element 92 has a lower longitudinal ridge 110 which is sized to fit within any one of corresponding holes 72,74 in a secure fit. Similarly, lips 104, 106 are provided at the ends of the track element 92 to fit into the widened portions at the ends of the holes in the divider insert, such as the widened portion 76.

The assemblies 20,22 may be shipped from a plant to a retail environment completely assembled, or for field assembly. Each assembly includes a tray, a divider insert, and as many product pushers as there are channels in the divider insert. The parts are put together simply. First, the divider insert 60 is located in the tray 30 so that is has a snug fit. The divider insert defines the channel size and has centrally located holes which overlie the female connector portions 40,42 of the tray. Thus, there is only possible mounting for a product pusher in each channel. The product pusher for each channel is located properly by fitting its longitudinal ridge 110 in the respective elongated hole in the divider insert, for example, hole 74, with the forward lip 106 engaging in the widened hole portion 76. When this happens, the male connector elements 100,102 will be securely located in the corresponding female connector portions 40,42. That completes the pusher assembly for the channel. The identical product pusher assembly steps are taken with respect to the other channels for the divider insert.

The assembly can then be loaded into the rack 10 and used in the retailing of the products desired. The tray assemblies may be lowered, as discussed above, for reloading or retracted for normal retail operation. Should it be desired to dispense a different product or the same product in a different size package, the apparatus very readily enables that to take place. That is, if, for example, the product width is to be decreased by one-fourth, then four side-by-side packages will fit in the tray 30. All that need be done is to use a new divider insert and an additional product pusher. The new divider insert would be made substantially as the one shown in FIG. 2, except with four, rather than three, channels and have them narrower. The old product pushers can still be used along with the new, fourth one, and all four will be properly positioned in the corresponding channels and locked properly in the corresponding female connector portions 40,42 by virtue of the predetermined location of the product pushers in the new divider insert. In addition, since the card channel 38 extends across the entire tray width, a new card can be provided along with the new divider insert. The new card can be provided with product identifying information corresponding to the new widths of the channels of the new divider insert so that, when installed in the forward card channel, it lines up with the channel extending behind it.

The invention also has the advantage that, by providing a new divider insert for each new package size, the rails 78,80 are always located at a proper position to minimize friction. Also, the pusher element 94 will always be located in the center of the channel, because the holes 70,72,74 can always be located centrally of the channel. This eliminates any binding which may occur if the product were being pushed from the side or other offset position.

The invention also includes variations on the embodiment as specifically disclosed herein. In particular, the holes in the middles of the channels need not be elongated or extend the majority the length of the channel, but could be simply located over the locations of the female connector portions 40,42, with appropriate modifications to the configuration of the ridge 110.

As can be seen, an advantage of the present invention is that the lower front portion of the tray assembly is curved so that it is no longer slanted facing downwardly, but faces horizontally so that, as the customer approaches the display, the product being displayed is easy to see.

Other types of connections between the tracks of the product pusher and the tray, other than the specific male and female connector portions described herein, may be substituted. In particular, snaps are contemplated. The height of the divider walls for the divider insert can be minimal, and the materials used can be thin and inexpensive, since this is a disposable component. The tray, pusher track, pusher element and divider insert are desirably made of melded high-impact polystyrene, The tray can be of varying widths, with widths of 18" up to 4 feet being specifically contemplated. Preferably, the rails 78,80 and the rails 98 in the top of the pusher track are formed to be at the same elevation in the assembled tray assembly.

Figure 8:
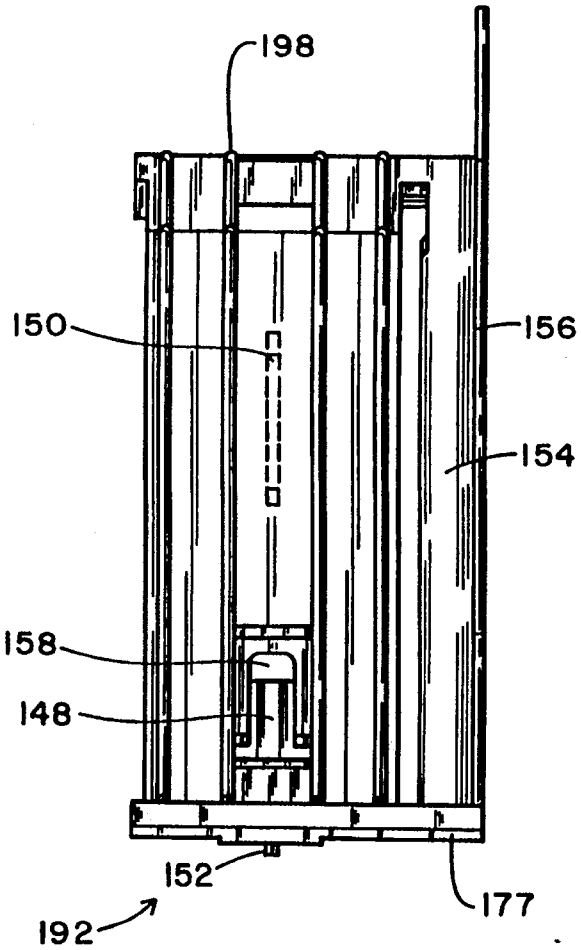
FIG. 8 is a top plan view of the track element of the product pusher component for use with the tray of FIG. 7.
Figure 7:
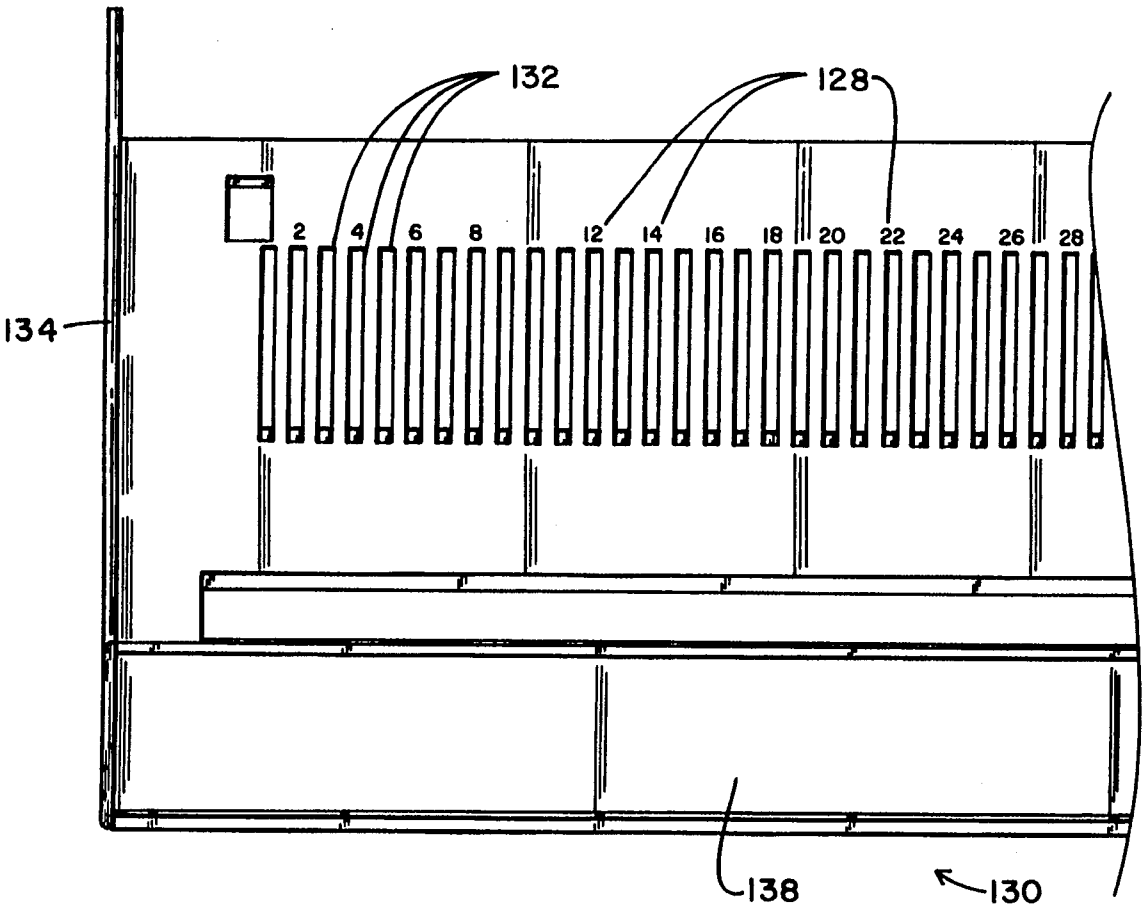
FIG. 7 is a front elevation view of one end of the tray component of an embodiment according to the second aspect, the remainder of the tray being broken away.
Figure 9:
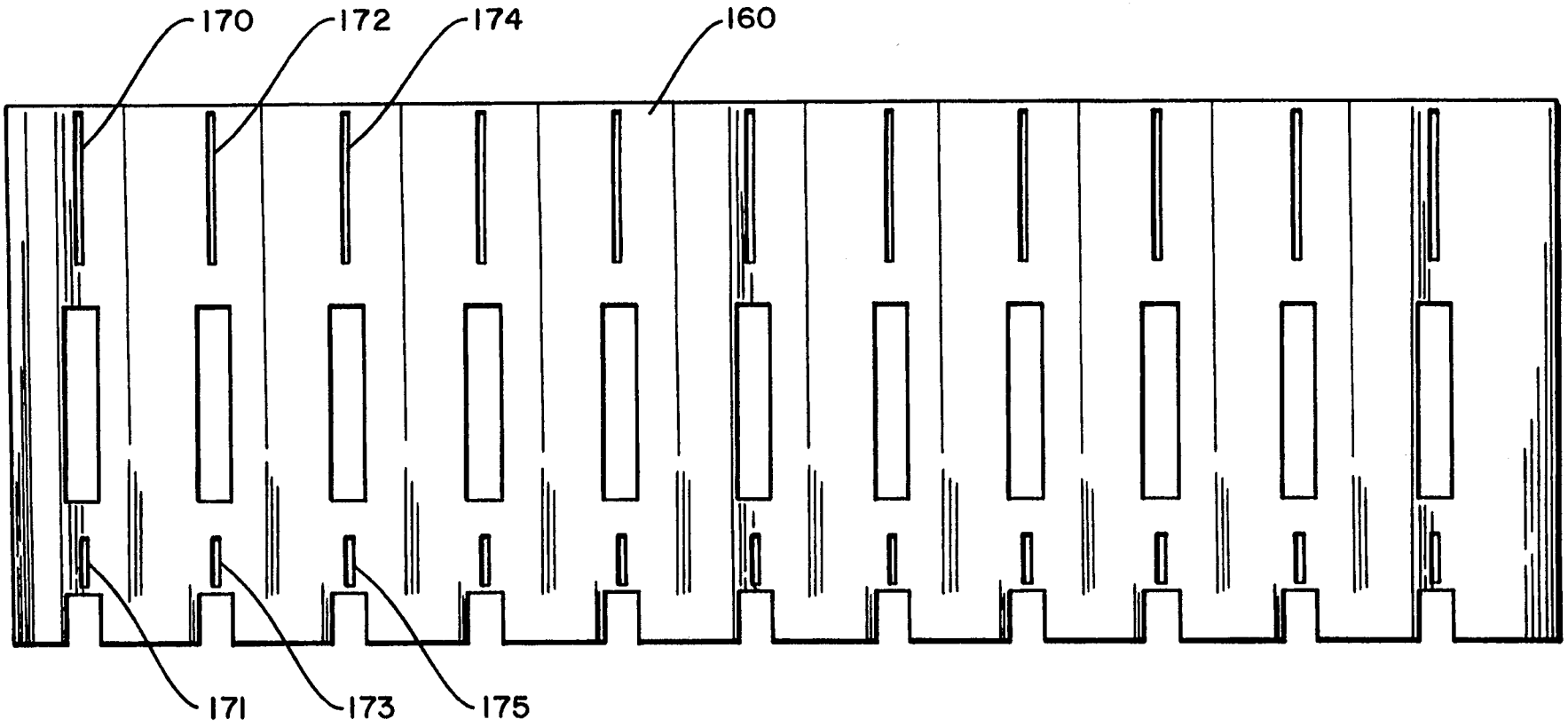
FIG. 9 is a top plan view of a template for optional use with the tray of FIG. 7.

FIGS. 7,8 and 9 illustrate the three main components of an embodiment according to the second aspect. As seen in FIG. 7 tray 130 has side walls 134 and a front-facing card channel 138. The card channel can receive a full-width card, like the cards described above with respect to the first aspect. A transparent product hold-back portion (not shown) can also be provided above the card channel. A plurality of recesses 132 are provided arrayed across the width of the tray. Similar recesses are also provided lower on the tray than those seen in FIG. 7, occluded by the card channel 138.

The recesses 132 are formed as depressions in the tray and are identified by labelling, such as numbers 128.

FIG. 8 shows a top view of a track element of a product pusher 190 for an embodiment according to the second aspect. The product pusher includes the track element 192, a pusher element, and a spring. The pusher element and the spring can be the same as those shown for the first aspect. The track element 192 includes rails 198 formed in the top of it, again to reduce friction for the product being moved along the track. The rails also provide a bed in which the spring can be housed to as to prevent the spring from interfering with the product resting on the track element. Protruding downwardly from the track are male connector portions 150,152.

Portion 150 is shown in phantom because it protrudes away from the viewer of the figure. The portions 150, 152 are sized to fit into the recesses 132 in the tray in a secure fit. As can be appreciated, the portions 152 fit into the recesses occluded by card channel 138 in FIG. 7. The tray 130 has a rearwardly extending boss, like the boss 35 of the tray of the first aspect, and the track elements have portions 177 to assist in locking the track elements in position in the tray 130 by fitting under the boss.

Each track element is provided with a lateral extension portion 154 having a raised sidewall 156 at its edge. Thus, locating the track elements in the tray defines channels between the sidewalls of adjacent track elements. Of course, the track element at the end of the tray need not have a side wall if the tray sidewall suffices. Alternatively, the tray need not have a sidewall on the end where the track element's sidewall will be positioned. Also, whether the sidewalls are on the right or left side of the track elements is immaterial, as long as there is consistency in placement.

The track element 192 is provided with a cutout 158 and a molded-in tab 148 extending into the space of the cutout. Thus, the tab can be used to grip the track element to pull it upwardly when the track element is to be removed from the tray.

The parts are put together simply. The product pushers and tray are accompanied by instructions for the proper placement of the product pushers in the tray. For example, the instructions may say to locate a product pusher in each of the recesses labeled as 4, 14, 24, 34, 44 etc. to achieve a channel width for the products comparable to the spacings between the spaces 4 and 14. Then, the store employee may locate the product pusher for each channel by fitting its male connector 150 into the enumerated recess in the tray with the forward lip 177 engaging under the boss of the tray. That completes the pusher assembly for the channel. The identical product pusher assembly steps are taken with respect to the other channels.

Alternatively, the product pushers may be installed with a template as a guide. FIG. 9 is a plan view of a template 160. The template is sized to be slightly smaller than and therefore to be able to fit into the tray 130 without sideways movement when it is in the tray. The template 160 is preferably a thin sheet—for example 1/32" thick, so that it does not interfere with the product pusher's obtaining a secure mounting the tray. The template helps in properly locating the product pusher. To do this, the template 160 is provided with a plurality of longitudinally extending holes, such as holes 170, 171, 172, 173, 174, 175. The upper holes 170, 172, 174 . . . are located to overlay selected ones of the recesses 132 when the template is located in the tray 130. The lower holes 171, 173, 175 . . . are located to overlay selected ones of the recesses occluded by the card channel 138 when the template is located in the tray 130. Other holes may be provided as shown to facilitate other engagements of the product pushers to the tray, as desired. When the template 160 is located in the tray 130, it has a snug fit. Thus, there is only possible mounting for a product pusher. The process can proceed as described above, using the exposed holes, rather than the numbers 128 as the guides for mounting the product pushers.

The assembly can then be loaded into the rack 10 and used in the retailing of the products desired, as discussed above, with respect to the first aspect. Should it be desired to dispense a different product or the same product in a different size package, the apparatus very readily enables that to take place. That is, if, for example, the product width is to be decreased by one-fourth, then four side-by-side packages will fit in the tray 130. If the numerical guides 128 are being used, all that need be done is to use an additional product pusher, and instruct the field personnel which of the guides 128 are to be used. If the template mode is being used, a new template would be made substantially as the one shown in FIG. 9, except with the holes 170, 172 . . . located where the product pushers are to be mounted. The old product pushers can still be used along with any new ones needed.

In addition, since the card channel 138 extends across the entire tray width, a new card can be provided along with the instructions for re-deploying the product pushers or the new template. The new card can be provided with product identifying information corresponding to the new widths of the channels so that, when installed in the forward card channel, it lines up with the channel extending behind it.

The embodiment shown in FIG. 10–13*a* provides further refinements to the trays shown in FIGS. 1–9. Those trays are fully transferrable to the embodiment of FIGS. 10–3*a*. What is modified in this embodiment is the housing. Instead of being a fixed rack 10 having built-in supports for the moveable trays, in this embodiment, greater flexibility of arrangements is obtained by provision of a specially designed rack.

The rack 200 is provided with a rectangular base 202, the four corners of which are provided with adjustable feet 208 to allow leveling, as is conventional. Extending upright from the base 202 are standards 204 and 206 along a back wall. Forwardly extending side walls 210 (only one of which is shown in FIG. 10) provide strength and rigidity.

Figure 11:
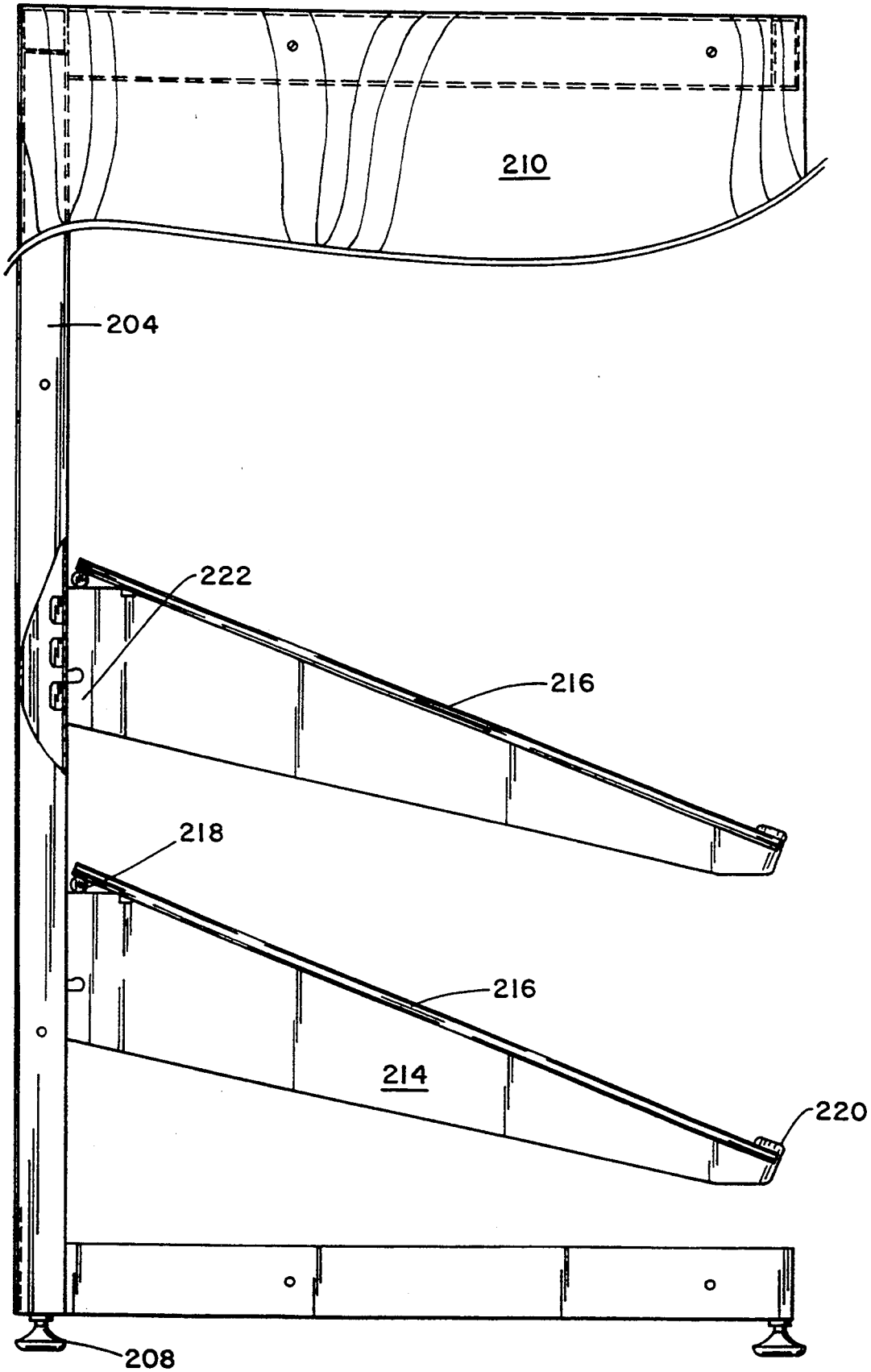
FIG. 11 is a side elevation view partially broken away of the embodiment of FIG. 10, somewhat rearranged.
Figure 12:
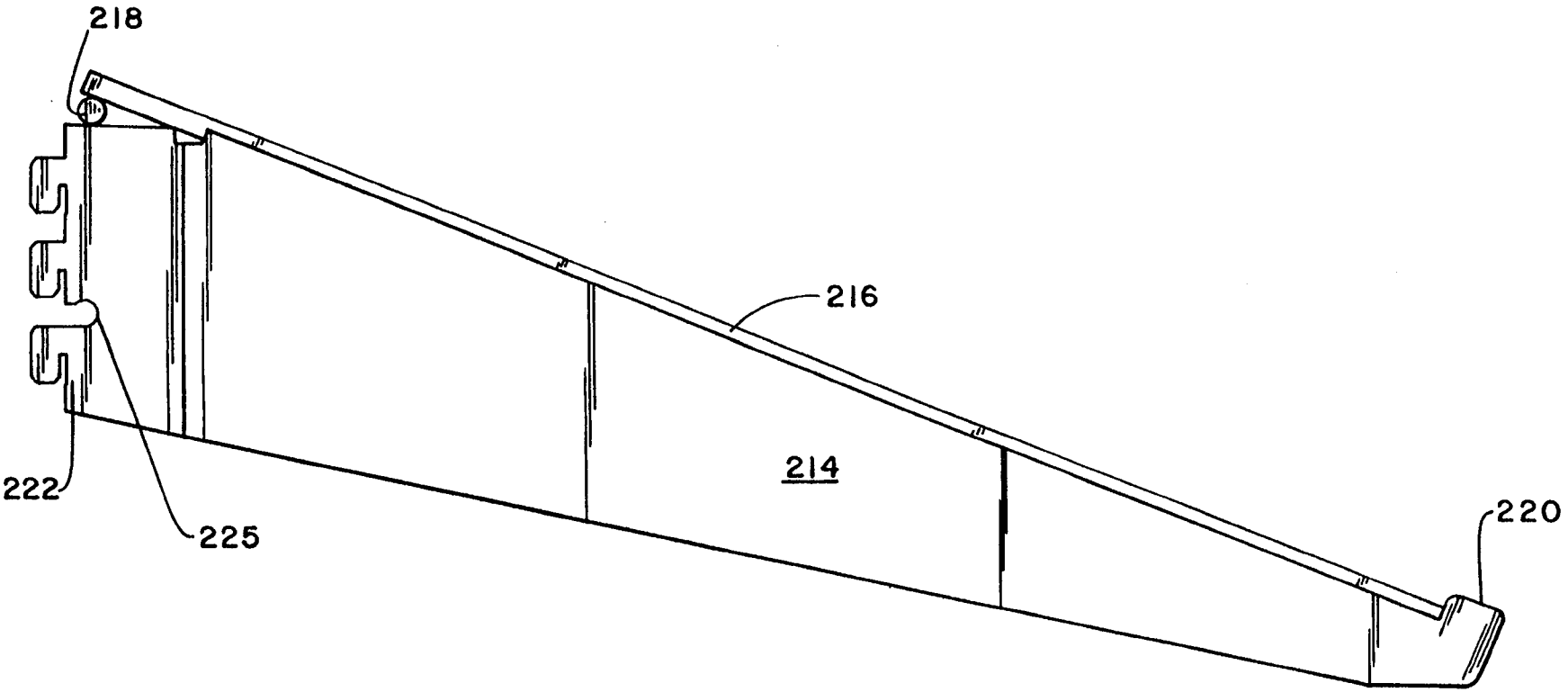
FIG. 12 is a side elevation view of a component of the embodiment of FIG. 10.

The standards 204 are provided with a plurality of equally spaced holes 230 along their lengths. As shown in FIG. 10, the standards 206 can be made of a double width. Preferably, however, the standard 206 is made up of two single standards 204 placed side-by-side. The affixation of the standard to the base 202 can be by any desired assembly. As shown in FIG. 10, a support 212 is provided having blade mountings 222 to the standards 204 and 206. Details of the mountings are shown in FIGS. 11 and 12. The support 212 as shown extending the full width across the rack 200 and including three pairs of forwardly extending rails 216. The rails 216 extend between a forward bar 220 and a rearward bar 218, which are joined with side walls 214 of the support 212.

In a commercial embodiment the support 212 is made 48-inches wide, thereby providing three 16-inch wide bays for the mounting of trays 226, entirely equivalent to the trays 20 and 22 described above. Alternatively, as shown in FIG. 10 above the support 212, a single 16-inch wide support 224 may be provided, again having a rear bar 218 and fore and aft extending rails 216. The trays 226 mount on the supports 212 and 224 exactly the same way the trays 20 and 22 mount in the rails 21 described above. Similarly, the forward bar 220 acts as a stop, exactly the same as the front bars 18 described above. Thus, the supports 212 and 224 may be mounted as desired to the plurality of holes 230 in the rear standards 204, 206 to provide optimum vertical spacing between adjacent trays. The tray spacing can be adapted as desired for the size of the product to be displayed in the trays. If it is desired to display a different size product, both horizontally and vertically, the change in horizontal size can be accommodated as described above, and the change in vertical size can be accommodated by changing the vertical spacing of the trays.

Figure 10:
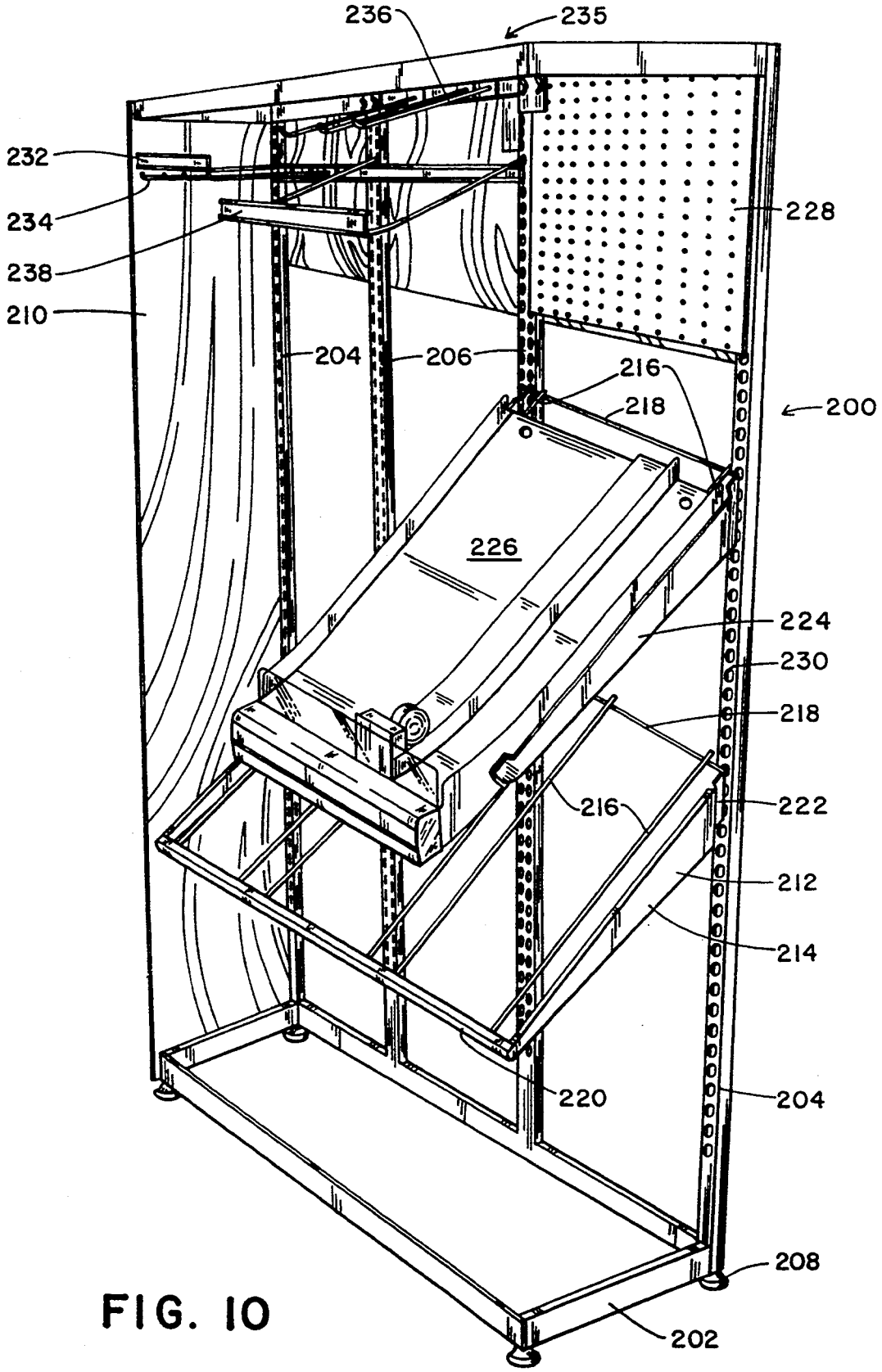
FIG. 10 is a perspective view of an alternate embodiment of the invention.

The standards 204, 206 of the rack 200 shown in FIG. 10 can also receive other types of displays, as desired. For example, a peg board section 228 can be mounted to the standards, and in turn, receive any desired peg board-type display. Alternatively, packages designed to be hung from rods may be displayed using the apparatus shown at 236, 238 or as shown at 232, 234.

Figures 13, 13A:
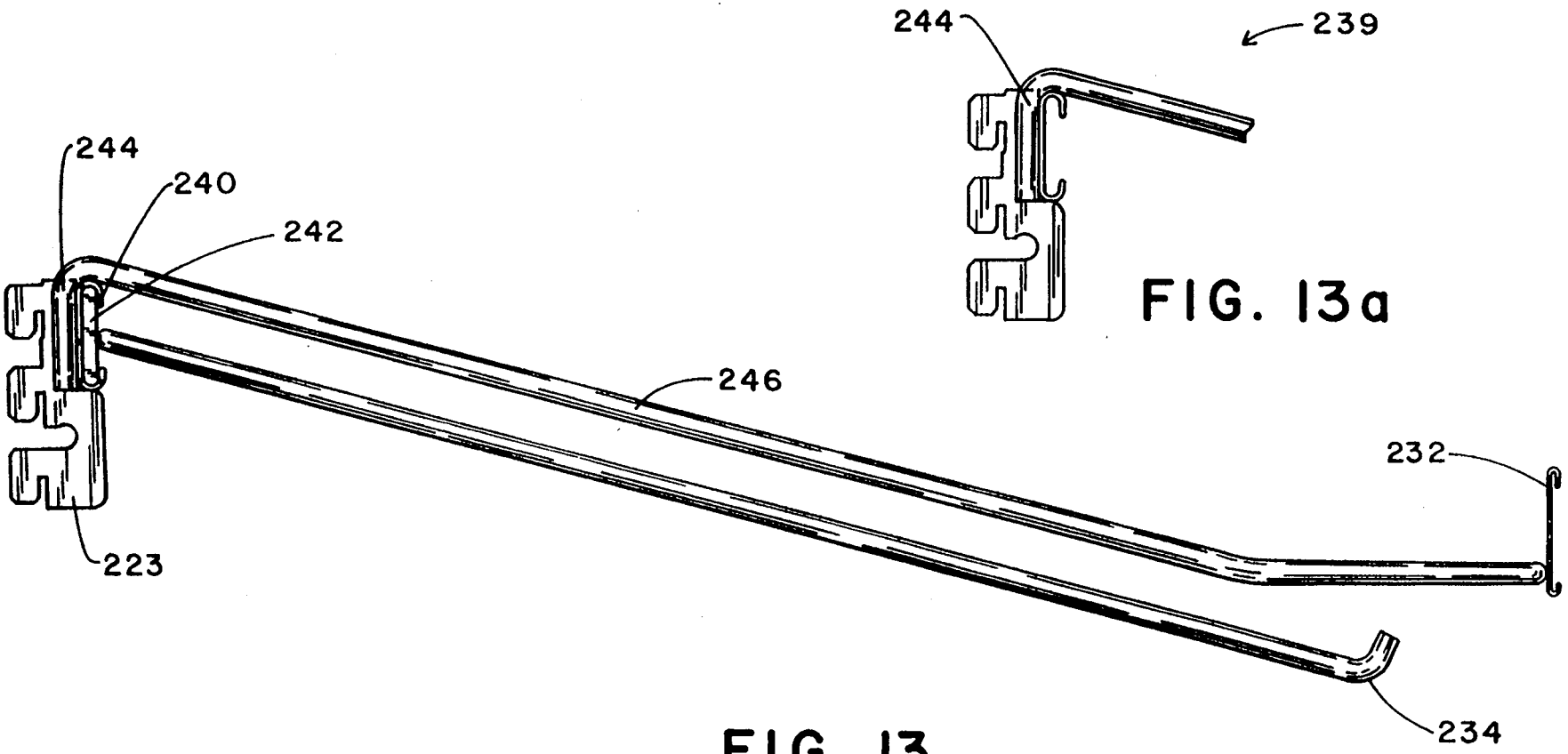
FIGS. 13 and 13*a* are side elevation views of other components of the embodiment of FIG. 10.

As seen in FIG. 13, a blade mounting 223 similar to blade mounting 222 used for the tray supports 214, 224 is provided with a channel 240 extending from one standard to the other. Rearward of the channel 240 is a pocket arranged to receive a downwardly extending extension 244 of a forward extending arm. Thus, as seen in FIGS. 10 and 13, the blade mounting 223 supports the channel 240 and a plurality of plates 242 slidingly received in the channel 240. The plates 242 have rigidly affixed to them as by welding, the forwardly extending pegs 234. Again, versatility is made possible by virtue of the slidability of the plates 242 in the channel 240, so that the side-by-side spacing of the pegs 234 can be arranged as desired. A card channel 232 affixed to the forward end of rod 246 received in the pockets of the blade mounting 232 can display any desired message, such as the trademark or generic name, price or any other desired information concerning the product suspended immediately below on the pegs 234.

Alternately, the message display can be located below the suspended product using the arrangement shown at 235 of FIG. 10 and FIG. 13*a*. In that embodiment two sets of blade mountings 223 are provided. The lower one has the forwardly extending bars 23*a* with the cross-wise extending card channel 238. The upper one has the rear channel 240 with the multiplicity of forwardly extending bars 234 mounted on plates 242 slidingly engaged in the channel 240. No forwardly extending bars 246 are used in the upper blade mounting of the assembly 236.

The locations of the various components described above can be mixed or matched as desired to display the products.

As noted above, in the preferred embodiments the various components can be provided in 48-inch-wide sizes to fill the 3 bays of the rack 200 or 16-inch wide sizes to be loaded in single bays. As will be appreciated, the number of bays and their sizes may be arranged as desired and still fall within the scope of the invention.

As seen in FIG. 12, the support 214 has integrally formed hook-shaped baldes brackets 222 which themselves include a recess 225 to receive a cam to help lock the blade in place in aperture the apprature 230. While the blade and aperture affixation mode has been shown with particularity, it will be appreciated that other modes of affixation of the supports and other components may be substituted, as will be apparent to those or ordinary skill in the art.

Those of ordinary skill in the art will appreciate that the invention may be carried out with various other modifications still within the scope of the present invention.

What is claimed is:

1. An apparatus for displaying goods in a retail environment comprising a frame having an upright standard with a plurality of affixation elements spaced along said standard, a plurality of supports affixed to said standard by affixation to said affixation elements and including forwardly-extending rails, a plurality of trays each including a plurality of location means across a width of said tray, each tray being supported on said rails of one of said supports, a plurality of product pushers releasably connected to said trays and positioned in said trays in reference to said location means, whereby goods to be displayed may be positioned forwardly of said product pushers to urge them to one end of said tray for retail purchase and the apparatus may be disassembled to arrange a different plurality of product pushers differently in said tray and a different plurality of supports and trays differently along said standard.

2. An apparatus for displaying goods in a retail environment as claimed in claim 1 wherein said frame has a plurality of said standards and each support is affixed to two standards.

3. An apparatus for displaying goods in a retail environment as claimed in claim 1 wherein said frame has sideboards and a rear board.

4. An apparatus for displaying goods in a retail environment as claimed in claim 1 wherein said affixation means comprises apertures in said standard and said supports are affixed to said standards by knife brackets which enter said apertures.

5. An apparatus for displaying goods in a retail environment as claimed in claim 1 wherein said frame has a plurality of standards spaced apart 16 inches.

6. An apparatus for displaying goods in a retail environment as claimed in claim 1 further comprising a rear board affixed to said standard at a location on said frame not occupied by a support and tray.

7. An apparatus for displaying goods in a retail environment as claimed in claim 6 wherein said rear board is a pegboard.

8. An apparatus for displaying goods in a retail environment as claimed in claim 1 further comprising a forwardly-extending rod assembly affixed to said standard at a location on said frame not occupied by a support and tray.

9. An apparatus for displaying goods in a retail environment as claimed in claim 8 wherein said frame has a plurality of said standards and said assembly is affixed to two standards, said affixation means comprises apertures in said standard and said assembly is affixed to said standards by knife brackets which enter said apertures.

10. An apparatus for displaying goods in a retail environment as claimed in claim 8 wherein said forwardly-extending rod assembly includes a cross-wise extending channel and said rods are selectively located along said channel.

11. An apparatus for displaying goods in a retail environment as claimed in claim 8 wherein said forwardly-extending rod assembly includes spacers and a product identification panel, said spacers projecting said panel forwardly from said standard and said panel adapted to receive product-identifying indicia.

12. An apparatus for displaying goods in a retail environment as claimed in claim 1 wherein said supports have crosswise-extending bars and said trays have first and second protrusions from their undersides, said first protrusion adapted to engage said bar to support said tray in a first, retracted package-displaying position, and said second protrusion adapted to engage said bar to support said tray in a second, extended, package-loading position.

13. An apparatus for displaying goods in a retail environment comprising a frame having sideboards, a rear board and a plurality of upright standards, each standard having a plurality of apertures spaced therealong, a plurality of supports having knife brackets and crosswise-extending bars, each support affixed to two of said standards by insertion of its knife brackets into apertures of the standards and each including forwardly-extending rails, a plurality of trays each including a plurality of location means across a width of said tray, each tray being supported on said rails of one of said supports, said trays having first and second protrusions from their undersides, said first protrusion adapted to engage said crosswise-extending bar to support said tray in a first, retracted package-displaying position, and said second protrusion adapted to engage said bar to support said tray in a second, extended, package-loading position, a plurality of product pushers releasably connected to said trays and positioned in said trays in reference to said location means, a forwardly-extending rod assembly affixed to said standards at a location on said frame not occupied by a support and tray, whereby goods to be displayed may be positioned forwardly of said product pushers to urge them to one end of said tray for retail purchase and the apparatus may be disassembled to arrange a different plurality of product pushers differently in said tray and a different plurality of supports, trays and forwardly-extending rod assemblies, differently along said standards.

14. An apparatus for displaying goods in a retail environment comprising a frame having an upright standard with a plurality of affixation elements spaced along said standard, a plurality of supports affixed to said standard by affixation to said affixation elements and including forwardly-extending rails, a plurality of trays each including a plurality of location means across a width of said tray, each tray being supported on said rails of one of said supports, a rear peg board affixed to said standard at a location on said frame not occupied by a support and tray, a plurality of product pushers releasably connected to said trays and positioned in said trays in reference to said location means, whereby goods to be displayed may be positioned forwardly of said product pushers to urge them to one end of said tray for retail purchase and the apparatus may be disassembled to arrange a different plurality of product pushers differently in said tray and a different plurality of supports and trays differently along said standard.

15. An apparatus for displaying goods in a retail environment as claimed in claim 14 wherein said frame has a plurality of said standards and each support is affixed to two standards.

16. An apparatus for displaying goods in a retail environment as claimed in claim 14 wherein said affixation means comprises apertures in said standard and said supports are affixed to said standards by knife brackets which enter said apertures.

17. An apparatus for displaying goods in a retail environment as claimed in claim 14 further comprising a forwardly-extending rod assembly affixed to said standard at a location on said frame not occupied by a support and tray.

18. An apparatus for displaying goods in a retail environment as claimed in claim 17 wherein said frame has a plurality of said standards and said assembly is affixed to two standards, said affixation means comprises apertures in said standard and said assembly is affixed to said standards by knife brackets which enter said apertures.

19. An apparatus for displaying goods in a retail environment as claimed in claim 17 wherein said forwardly-extending rod assembly includes a crosswise-extending channel and said rods are selectively located along said channel.

20. An apparatus for displaying goods in a retail environment as claimed in claim 17 wherein said forwardly-extending rod assembly includes spacers and a product identification panel, said spacers projecting said panel forwardly from said standard and said panel adapted to receive product-identifying indicia.

* * * * *